United States Patent [19]

Gies

[11] Patent Number: 4,862,933

[45] Date of Patent: Sep. 5, 1989

[54] DOSER FOR STERILIZER OF A PACKAGING SYSTEM

[75] Inventor: Burkhard Gies, Wuppertal, Fed. Rep. of Germany

[73] Assignee: Muller GmbH & Co. KG., Wuppertal, Fed. Rep. of Germany

[21] Appl. No.: 191,204

[22] Filed: May 6, 1988

[30] Foreign Application Priority Data

May 14, 1987 [DE] Fed. Rep. of Germany ..... 3716096

[51] Int. Cl.[4] ..... G01F 11/00; B67D 1/16; G05B 17/00; B65B 55/00

[52] U.S. Cl. ..... 141/130; 222/109; 222/287; 222/318; 422/28; 422/116; 422/304; 53/426; 99/452; 239/61; 239/70; 261/78.2; 261/36.1; 261/27

[58] Field of Search ..... 141/130; 222/109, 108, 222/318, 282, 287; 53/426, 425, 141; 99/452; 422/28, 116, 304; 134/102; 239/61, 69, 70; 128/200.16, 200.18, 200.21, 200.22; 261/78.2, 78.1, 36.1, 36.2, 27, 26, DIG. 8

[56] References Cited

U.S. PATENT DOCUMENTS

| | | | |
|---|---|---|---|
| 1,973,755 | 9/1934 | Geyer | 222/318 |
| 2,614,742 | 10/1952 | Price | 222/109 |
| 3,566,575 | 3/1971 | Lisiecki | 53/426 |
| 4,086,305 | 4/1978 | Dobritz | 261/36.1 |
| 4,204,612 | 5/1980 | Schrader et al. | 239/61 |
| 4,409,775 | 10/1983 | Brody et al. | 53/426 |
| 4,570,495 | 2/1986 | Terada | 141/130 |
| 4,637,378 | 1/1987 | Sasa | 134/102 |
| 4,680,163 | 7/1987 | Blidschun et al. | 422/28 |
| 4,746,067 | 5/1988 | Svoboda | 128/200.21 |

FOREIGN PATENT DOCUMENTS

| | | | |
|---|---|---|---|
| 0992070 | 1/1983 | U.S.S.R. | 128/200.21 |

*Primary Examiner*—Henry J. Recla
*Assistant Examiner*—J. Casimer Jacyna
*Attorney, Agent, or Firm*—Herbert Dubno; Andrew Wilford

[57] ABSTRACT

A conductive liquid is dosed with a vessel having an upper rim and with a dip tube having a lower end projecting down into the vessel below the rim thereof. The vessel is periodically overfilled with the liquid such that periodically the liquid overflows the rim. Immediately after each overfilling of the vessel, the liquid is aspirated from the vessel through the dip tube until the lower end of the dip tube is above the surface of the liquid in the vessel. The resistance between the dip tube and the liquid in the vessel is continuously monitored and an error signal is generated either when the detected resistance falls below a predetermined threshold corresponding generally to that of the liquid after the overfilling but before the aspirating or when the detected resistance is substantially above the threshold after the aspirating and before the next overfilling. The flow of liquid out of the vessel is impeded except over the rim and through the dip tube at least during the aspirating step.

14 Claims, 4 Drawing Sheets

CONTROLLER
60
39
36
L
45
59
30
37
32
27
41
46
L
a
38
33
26
42
28
35
34
57
G
40
58
$H_2O_2$
44
62
43
29
61
35
31
63
P

DOSER FOR STERILIZER OF A PACKAGING SYSTEM

FIELD OF THE INVENTION

The present invention relates to a device for delivering a liquid in exact doses. More particularly this invention concerns such a doser which feeds a sterilizing liquid to the sterilizing unit in a packaging operation.

BACKGROUND OF THE INVENTION

Yoghurt, pudding, butter, and other semiliquid materials, typically dairy-type foodstuffs, are normally packaged in a cup having a circular upper edge that is sealed to the periphery of a circular foil cover disk. The filling and sealing are done under substantially sterile conditions so that the hermetically packed material will not spoil unless opened. Such a package can be made at very low cost yet can provide a sealed sterile containment for the foodstuff.

The apparatus for producing such a package normally includes a picker device that pulls the cups from a supply and fits them to seats at the extreme upstream end of the upper stretch of a conveyor belt or chain. The cups pass through a device that picks out doubled cups and fills in where cups are missing, then they pass through an apparatus that sterilizes them with hydrogen peroxide or the like. Subsequently the cups are filled downstream of the sterilizer by a machine which deposits the product into each cup. Cover disks are set atop the filled and sterilized cups and the covers are sealed to the rims of these cups. The seal of each cup and cover is then tested and finally an unloader takes the packages off the conveyor chain, automatically culling out those packages found to have imperfect seals.

The sterilizing device normally sprays each cup and even the cover with a msit of dydrogen peroxide. Although only a small amount of this sterilizing liquid is needed with each cycle of the step-wise operating machine, it is essential that the amount used be very accurately dosed. If too little sterilizing liquid is used the product in the unsterile package will spoil; if too much is used the product will be flooded and diluted. Either way the product will be ruined.

Accordingly the standard procedure is to use a dosing device comprising a sight-glass reservior into which the sterilizing liquid is fed by a continuously operating light-duty pump whose intake is connected to a supply filled with the liquid. A riser tube has an upper end fixed at a location above the base of the reservoir and is connected to the liquid supply, which itself is at a lower level. Thus the liquid level in the reservoir is always level with the rim of the riser tube as any excess liquid will drain out through the riser tube.

The spray nozzle has an input connected to a cup that is dipped with each cycle into the reservoir. Since the reservoir's level remains substantially unchanged, such a procedure will always dip out an exactly equal quantity of the sterilizing liquid which is then aspirated by a tube connected to the spray nozzle of the sterilizer, which typically works in the manner of a jet-pump aerosol, that is with a jet of gas operating over a venturi connected to the intake tube. Thus with each cycle or step of the machine the doser, whose pump is going continuously, must dip out and then aspirate a small quantity of the sterilizing liquid. If this is attempted too quickly the resultant splashing and spilling will cause loss of some of the ladled-up liquid and generally irregular dosing.

In order to verify that the system is working properly a monitoring apparatus is connected to the intake tube of the nozzle and normally also to the cup it draws from, these two elements being electrically isolated so that there is only a low-resistance path between them when the sterilizing liquid contacts and bridges them. Under normal circumstances at the start of an aspiration cycle, which takes place intermittently like most functions of the packaging machine, the liquid bridges the intake tube and cup and creates a very low-resistance path betwen them. On the contrary at the end of the intake cycle, when the liquid in the dip cup is depleted, the resistance is high because the liquid has been sucked out of this cup and the dip tube is separated by an air space from the cup. Such a device is sold under the tradename "Level Device GVD" by the firm of Helmut Negele (Hauptstrasse 14,D-8941 Egg a.d. Gunz, West Germany). Thus if the feed pump is not working, the cup will not be filled at the start of the cycle and this device can shut down the line, and if the intake line to the nozzle or the nozzle is clogged and the liquid is not sucked out of the cup by the end of the cycle, the system is similarly shut down.

Such a system is fairly complicated. The various reciprocating parts are subject to considerable wear. In addition resetting it to dose a greater or smaller quantity of the liquid is complex because, as mentioned above, faster operation involves loss of efficiency and liquid with each operation.

OBJECTS OF THE INVENTION

It is therefore an object of the present invention to provide an improved doser and dosing method.

Another object is the provision of such a doser which overcomes the above-given disadvantges, that is which is of simple construction and which is easy to adjust.

A further object is to provide such a doser and dosing method which are particularly usable to feed a sterilizer in a packaging plant for dairy products and the like.

SUMMARY OF THE INVENTION

A conductive liquid is dosed according to this invention with a vessel having an upper rim and with a dip tube having a lower end projecting down into the vessel below the rim thereof. The vessel is periodically overfilled with the liquid such that periodically the liquid overflows the rim. Immediately after each overfilling of the vessel, the liquid is aspirated from the vessel through the dip tube until the lower end of the dip tube is above the surface of the liquid in the vessel. The resistance between the dip tube and the liquid in the vessel is continuously monitored and an error signal is generated either when the detected resistance falls below a predetermined threshold corresponding generally to that of the liquid after the overfilling but before the aspirating or when the detected resistance is substantially above the threshold after the aspirating and before the next overfilling. The flow of liquid out of the vessel is impeded except over the rim and through the dip tube at least during the aspirating step. The dosing apparatus according to the invention therefore comprises the vessel and dip tube, plus a pump for periodically overfilling the vessel and a controller that alternates operation of the aspiration means connected to the dip tube and the pump.

This system involves no movement of the dip tube and/or vessel, so that its structure is fairly simple. Furthermore a pump is used that is set up to cycle once for each step of the packaging machine and supply an overabundance of the liquid, the unused part serving to flush the machine and keep it clear. Similarly the aspirating device is set up to suck up all the available fluid, that is everything in the space above the lower edge of the dip tube and below the rim of the vessel, which space is hereinafter referred to as the vessels effective volume. Both these elements—the pump and the aspirator—can be set to cycle very rapidly. The doser according to this invention can therefore keep up with even the fastest operation cycle, and there is no loss of dosing accuracy with speed.

Normally according to this invention the vessel is a riser tube centered on an upright axis and the pump unit includes a reservoir at least generally coaxially and spacedly surrounding the riser tube, a pump having an intake connected to the reservoir below the rim of the riser tube and an output connected to the riser tube, and means for preventing flow back from the riser tube into the supply. The reservoir has a base and the riser tube projects axially upward through the base and the riser tube is formed by a fitting projecting axially upward through the base.

In this arrangement it is relatively easy to set the machine for doses of different size, simply by varying the effective volume. This can be done by providing a connection, e.g. screwthreads, between the fitting and the base for axially displacing and arresting the fitting in the base and thereby varying the axial distance between the lower dip-tube end and the upper riser-tube rim and the volume of liquid aspirated with each cycle. It is also possible for the lifting to have an upwardly tapered surface extending from an outlet port and formed offset therefrom with a plurality of such vessels. It is possible for the vessels to be all of the same effective volume and to each be associated with a respective dip tube having its lower end in the respective vessel. To vary the dose rate however the vessels can all be of different effective volume in which case the fitting and dip tube are relatively angularly displaceable to fit the dip-tube lower end into any of the vessels. In this case the fitting is rotatable and the dip tube is generally fixed and a spring-loaded latch arrangement is provided to secure the fitting in angularly offset positions corresponding to different dosages.

In the multiple vessel arrangement normally the upper surface formed with the vessels is substantially frustoconical and centered on a vertical axis and the outlet port is at the axis.

DESCRIPTION OF THE DRAWING

The above and other objects, features, and advantages will become more apparent from the following, it being understood that any feature described with reference to one embodiment of the invention can be used where possible with any other embodiment and that reference numerals not specifically mentioned with reference to one figure but identical to those of another refer to elements that are functionally if not structurally identical. In the accompanying drawing.

SPECIFIC DESCRIPTION

Figure 1:
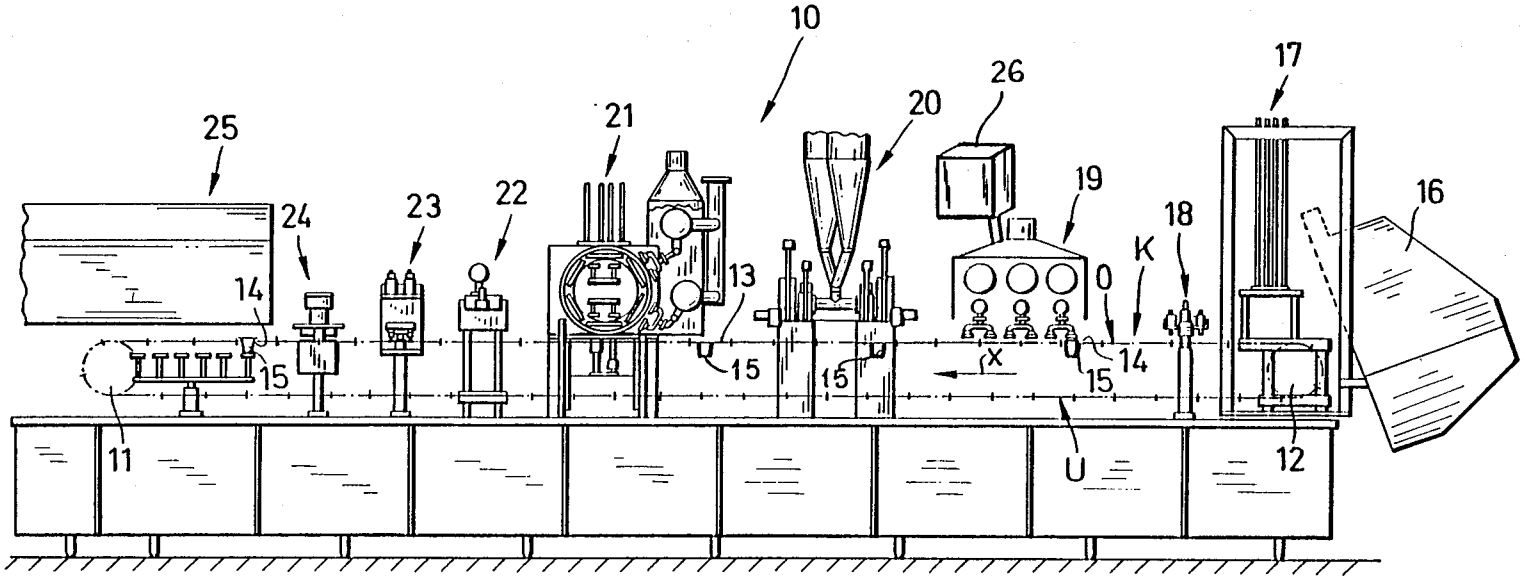
FIG. 1 is a small-scale side view of a packaging apparatus for use with the doser of this invention.

As seen in FIG. 1 a yoghurt packaging system 10 has a throughgoing endless conveyor chain K with an upper stretch O and a lower stretch U spanned over upstream and downstream sprockets 11 and 12. The chain K is comprised of a succession of link plates 13 each formed with a row of eight seats 14 which in the upper stretch hold respective cups 15. The cups 15 advance in a transport direction x (right to left in FIG. 1) eight abreast through the machine 10.

A picker device 17 pulls the cups 15 from a supply 16 and fits them to the seats 14 at the extreme upstream end of the upper stretch U of the belt K. The cups 15 pass through a device 18 that picks out doubled cups and fills in where cups 15 are missing, then they pass through an apparatus 19 that sterilizes them with hydrogen peroxide or the like that it receives from a precision dosing unit 26. Subsequently the cups 15 are filled downstream of the picker 17 by a machine 20 which here deposits yoghurt into each cup 15. Cover disks are set atop the filled and sterilized cups 15 by a device 21 and a further apparatus 22 seals the covers to the rims of the cups 15. The date is stamped on the sealed covers by a printer 23. The seal of each cup 15 and cover is then tested by an apparatus 24 and finally an unloader 25 takes the packages off the conveyor chain K, automatically culling out those packages found to have imperfect seals.

This system 10 operates in steps with sixteen cups 15 filled; sterilized, and so on each time the chain K stops. Such a machine can be operated to produce 33,600 packages per hour, so that the machine cycles about 35 times per minute, or better than one cycle every 2 seconds. A controller 60 (FIG. 2) is connected to all of the devices 17 through 26 to operate them stepwise and synchronously.

Figure 2:
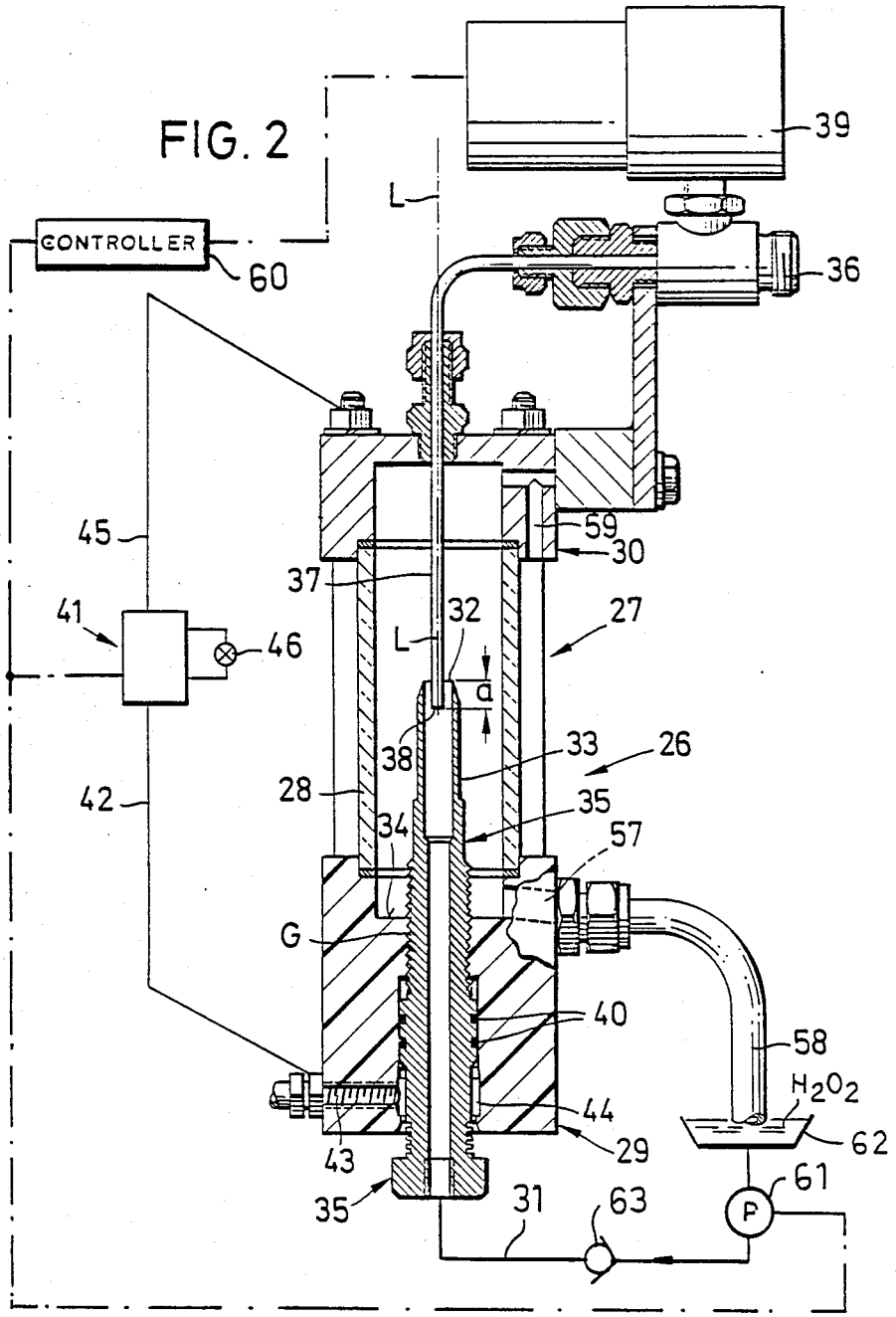
FIG. 2 is a partly diagrammatic vertical section through the doser according to the present invention.

As shown in FIG. 2 the dosing device 26 has a reservoir 27 formed by a cylindrical sight-glass tube 28 fitted at its lower end in an insulating synthetic-resin base 29 and at its upper end in a conductive cap 30. A riser tube 33 centered on an axis L coaxial with that of the tube 28 is formed on the upper end of a tubular feed fitting 35 and has a circular upper end or rim 32 centered on the axis L. This tube 33 projects upward from a floor 34 of the reservoir 27 to about the middle of the tube 28. The fitting 29 is formed with a drain hole 57 that opens at the floor 34 and that is connected via a drain conduit 58 to a lower-lying supply 62 filled with sterilizing liquid, here hydrogen peroxide.

A pump 61 has an intake that can draw the liquid from the supply 62 and feed it through a check valve 63 intermittently to a line 31 that is connected to the lower end of the tubular fitting 35. This pump 61 as will be described below periodically injects enough of the liquid into the tube 33 to cause it to overflow the rim 32 and then drain from the reservoir 27 via the hole 57 and line 58. The cap 30 is formed with a vent hole 59 to prevent vapor lock in the reservoir 27.

Projecting coaxially down through the cap 37 is a thin metal dip tube 37 of substantially smaller outer diameter than the inner diameter of the tube 33. This tube 37 has a lower end 38 that lies parallel to and at a spacing a below the upper rim 32 of the tube 33. This dip tube 37 is connected to an aerosol nozzle 36 also connected to a pressurized-gas supply 39 operated periodically by the controller 60, immediately after the pump 61 is stopped.

Thus normally the pump 61 cycles to overfill the tube 33, with the excess liquid draining back to the supply 62. Then the gas source 39 is actuated to aspirate all the liquid in the tube 33 above the lower end 38 of the dip tube 37. Thus with each such two-part cycle, exactly the same quantity of liquid will be dosed.

To a adjust the quantity, which is proportional to the size of the axial spacing a, the fitting 35 is formed with a screwthread G. To reduce the quantity, the fitting 35 is screwed down and to increase it, it is screwed up into the base 29. To prevent leakage two O-rings 40 fit in the base 29 around the fitting 35.

According to this invention a level device 41 of the type referred to above is employed. It is connected on one side via a line 42 to a contact 43 that engaged in a groove 44 in the side of the conductive fitting 35. On the other side it is connected via a wire 45 to the conductive cap 30 which is in electrical contact with the conductive dip tube 37. This device 41 is connected to the controller 60 and to an alarm lamp 46. It is effective to continuously monitor the resistance between its lines 42 and 45. The liquid from the supply 62 is highly conductive while the air in the reservoir 27 is not, so that the resistance sensed will either be extremely high or very low. Trouble with the system is indicated in two main ways:

1. When immediatley after the pump 61 has cycled the resistance is high because the tube 37 is not immersed in the liquid in the tube 33, this indicates that the supply 62 is empty, the line 31 blocked, the valve 63 permitting backflow, or some other critical feed error.
2. When immediately after the gas supply 39 operates to aspirate the liquid from the top of the tube 33 the resistance is low, indicating that the tube 37 is still immersed in the liquid, this indicates that something in the outlet circuit is amiss.

Either circumstances warrants shutting down the entire packaging line and correcting the problem before resuming operation because when at either of these critical parts of the operation cycle the resistance detected is not the high or low level it should be, this indicates that some packages are not being sterilized. The construction of the device makes the opposite problem—overfeed to flood the objects being sterilized—virtually impossible.

Figure 3:
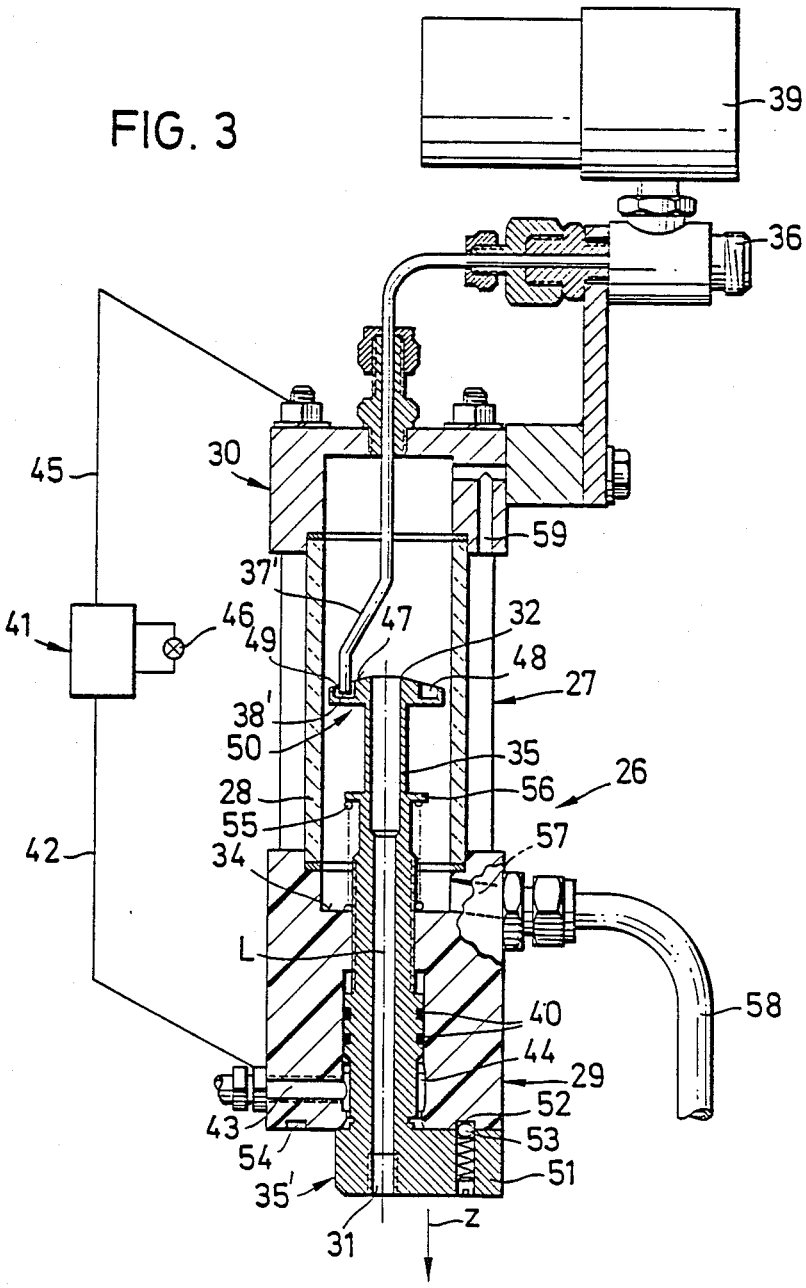
FIG. 3 is a view like FIG. 2 of another doser according to this invention.

In the system of FIG. 3 identical reference numerals are assigned to functionally identical structure as in FIG. 2. Here, however, the tube rim 33 is continued outward and downward from the axis L by an end part 50 having a frustoconical surface 47 formed offset from the center with upwardly open pockets 47 and 48 which are of different volume. In addition an offset dip tube 37' is used, that is one whose lower end 38' is parallel to but radially offset from the axis L so that it can engage in whichever pocket 47 or 48 is aligned axially beneath it.

In addition in this arrangement the fitting 35' is not threaded, that is it can rotate about the axis L in the base 30 without moving axially. A spring 55 in the reservoir 27 surrounding the fitting 35' is braced downward against the floor 34 of the reservoir 27 and upward against a snap ring 56 carried on the fitting 35' so as to urge it continuously upward so that a handle 51 at its lower end bears axially upward against the bottom of the base 29.

A spring-loaded ball 53 is urged axially up in the handle 51 against the bottom of the base 29 and can engage in a recess 52 or 54 therein. When engaged in the recess 52 the pocket 49 is axially aligned with the lower end 38' of the dip tube 37' and when in the pocket 54 with the pocket 48. The fitting 35' is positively held in either position. The amount of liquid aspirated on each cycle is a direct function of the effective volume of whichever pocket 48 or 49 the end 38' is engqaged in. To change the end 38' from one pocket to the other, the fitting 35' is pulled axially backward in direction z to pull the end part 50 clear of the tube 37, the fitting 34' is rotated to the desired position which is normally inscribed on the base 29, and then the fitting 35' is released to let the spring 55 pull it back up with the appropriate pocket up over the end 38'.

With this arrangement each cycling of the pump 61 floods the entire surface 47 to fill all the openings 47 and 48 thereof to overflowing. Thus all that needs to be done to change dosage is to reset the fitting 34'. The pump 61 need not be adjusted or reset as it is sufficient to fill the largest pocket on the end part 50, and there can be a large number if desired.

Figure 4:
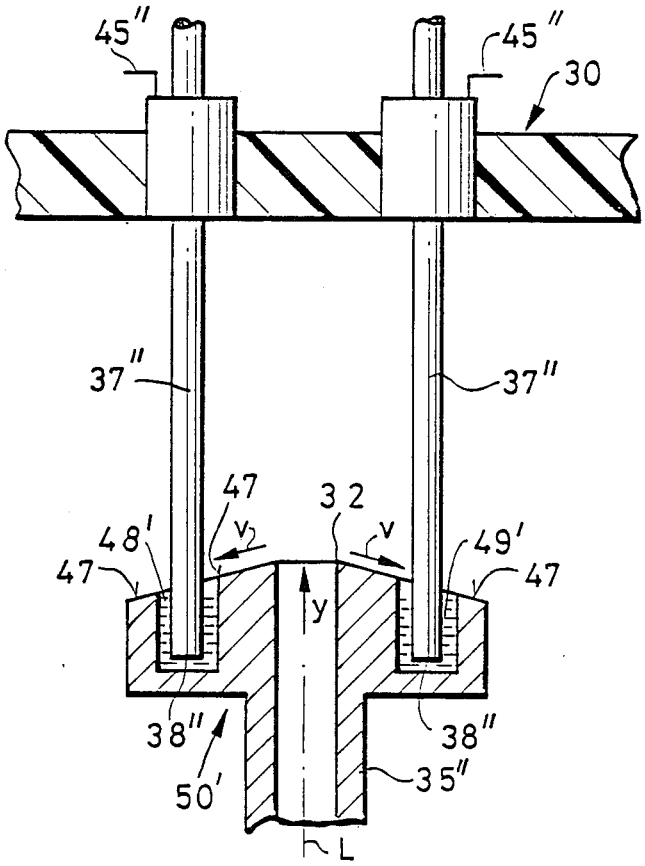
FIG. 4 is a detail view on another variation of the system of this invention.

FIG. 4 shows a system where the end part 50 has two pockets 48' and 49' that are of identical volume, size, and shape. The lower end 38'' of a respective dip tube 37'' connected to a respective line 45'' itself connected to a respective level device 41 engages in each of these identical pockets 48' and 49'. Thus each time liquid rises up in the fitting 35'' as indicated by arrow y and then down over the surface 47 as indicated by arrows v, all pockets 48'' and 49'' are filled. In fact sixteen pockets can be formed so that there will be a separate alarm light 46 for each station of the sterilizing unit.

I claim:

1. An apparatus for dosing a conductive liquid from a supply of the liquid to a user, the apparatus comprising;

a housing; at least one vessel supported in said housing and having an upper rim;

a dip tube supported in said housing and normally fixed relative to the vessel and having a lower end projecting downward with clearance into the vessel below the rim thereof;

pump means for periodically supplying enough of the liquid from the supply to the vessel to cause the liquid to fill the vessel and overflow the rim thereof and for collecting the overflow below the rim;

intake means adapted to be connected to the user and associated with said dip tube for periodically aspirating the liquid through the dip tube in the vessel above the lower end of the dip tube and feeding it to the user;

control means connected to the pump means and intake means to operate the same alternately with the intake means only aspirating when the pump means is not supplying and the pump means only supplying when the intake means is not aspirating; a riser tube centered in said housing and connecting said pump means to said vessel; and said housing includes a reservoir at least generally coaxially surrounding the riser tube for receiving said overflow to be collected by said pump means.

2. The apparatus defined in claim 1 wherein the pump means includes a pump having an intake connected to the reservoir below the rim of the riser tube and an output connected to the riser tube, and means for preventing flow back from the riser tube into the supply.

3. The apparatus defined in claim 2 wherein the reservoir has a base and the riser tube projects axially upward through the base.

4. The apparatus defined in claim 3 wherein the riser tube is formed by a fitting projecting axially upward through the base.

5. The apparatus defined in claim 4, further comprising means connected between the fitting and the base for axially displacing and arresting the fitting in the base and thereby varying the axial distance between the lower dip-tube end and the upper riser-tube rim and the volume of liquid aspirated with each cycle.

6. The apparatus defined in claim 5 wherein the means for axially displacing includes interengaging screwthreads on the fitting and base.

7. The apparatus defined in claim 1 wherein the control means includes means for alternately operating the pump means to overfill the vessel and the intake means to aspirate liquid from the vessel; and means for detecting the resistance between the dip tube and the liquid in the vessel and generating an error signal when the detected resistance falls below a predetermined threshold after aspiration by the intake means and before overfilling by the pump means and when the detected resistance is substantially above the threshold after overfilling by the pump means and before aspiration by the intake means.

8. The apparatus defined in claim 1 wherein said riser tube projects upwardly through the housing and terminates in an outlet port surronded by an annular downwardly tapered surface, and a plurality of said vessels being formed in said tapered surface concentric to said outlet port.

9. The apparatus defined in claim 8 wherein the vessels are all of the same effective volume.

10. The apparatus defined in claim 9 wherein the apparatus has a plurality of such dip tubes each having its lower end in the respective vessel.

11. The apparatus defined in claim 8 wherein the vessels are all of different effective volume, the riser tube and dip tube being axially and angularly displaceable with respect to each other to fit the dip-tube lower end into any of the vessels.

12. The apparatus defined in claim 11 wherein the riser tube is rotatable and the dip tube is generally fixed.

13. The apparatus defined in claim 8 wherein the surface is substantially frustoconical and centered on a vertical axis, the outlet port being at the axis.

14. The apparatus defined in claim 8 wherein the pump means includes a pump having an intake connected to the reservoir below the surface and an output connected to the outlet port, and means for preventing flow back from the outlet port into the supply.

* * * * *